US009777728B2

(12) United States Patent
Thomas et al.

(10) Patent No.: US 9,777,728 B2
(45) Date of Patent: Oct. 3, 2017

(54) PUMP WITH STATOR AND ROTOR SECTION ATTACHMENT FEATURES

(75) Inventors: Gareth David Thomas, Hollingworth (GB); Paula Jane Edwards, Audenshaw (GB)

(73) Assignee: NOV PROCESS & FLOW TECHNOLOGIES UK LIMITED, Stonehouse, Gloucestershire (GB)

( * ) Notice: Subject to any disclaimer, the term of this patent is extended or adjusted under 35 U.S.C. 154(b) by 393 days.

(21) Appl. No.: 13/055,442

(22) PCT Filed: Jul. 28, 2009

(86) PCT No.: PCT/GB2009/001857

§ 371 (c)(1),
(2), (4) Date: Jan. 21, 2011

(87) PCT Pub. No.: WO2010/012993

PCT Pub. Date: Feb. 4, 2010

(65) Prior Publication Data

US 2011/0123380 A1 May 26, 2011

(30) Foreign Application Priority Data

Jul. 28, 2008 (GB) ..... 0813790.3

(51) Int. Cl.
*F04C 2/107* (2006.01)

(52) U.S. Cl.
CPC ..... *F04C 2/1075* (2013.01); *F04C 2230/70* (2013.01)

(58) Field of Classification Search
CPC ..... F04C 2230/70; F04C 2/1075
USPC ..... 418/48, 49, 51, 39, 70
See application file for complete search history.

(56) References Cited

U.S. PATENT DOCUMENTS

| | | | | |
|---|---|---|---|---|
| 3,011,445 | A * | 12/1961 | Bourke | 418/48 |
| 3,512,904 | A * | 5/1970 | Allen | 418/48 |
| 5,318,416 | A * | 6/1994 | Hantschk et al. | 418/48 |
| 5,474,432 | A * | 12/1995 | Hulley et al. | 418/48 |
| 5,688,114 | A * | 11/1997 | Millington et al. | 418/48 |
| 6,877,967 | B2 * | 4/2005 | Gantenhammer | 418/48 |
| 2005/0084366 | A1 | 4/2005 | Hegebarth | |

(Continued)

FOREIGN PATENT DOCUMENTS

| | | |
|---|---|---|
| EP | 1 650 403 A1 | 4/2006 |
| GB | 2 377 256 A | 1/2003 |

(Continued)

OTHER PUBLICATIONS

Human translation of Japanese Patent Publication JP 45-14469, translated on Apr. 2016.*

*Primary Examiner* — Mary A Davis
(74) *Attorney, Agent, or Firm* — Kilpatrick Townsend & Stockton LLP

(57) ABSTRACT

A progressive cavity pump is provided, having a stator section and a rotor section axially aligned with and surrounded by the stator section, a drive shaft connection section and a suction chamber, arranged between the stator section and the drive shaft connection section; wherein the suction chamber is configured such that it can be disassembled without moving the stator section or the drive shaft connection section, thereby facilitating the performance of maintenance operations.

17 Claims, 3 Drawing Sheets

(56) References Cited

U.S. PATENT DOCUMENTS

Figure 1:
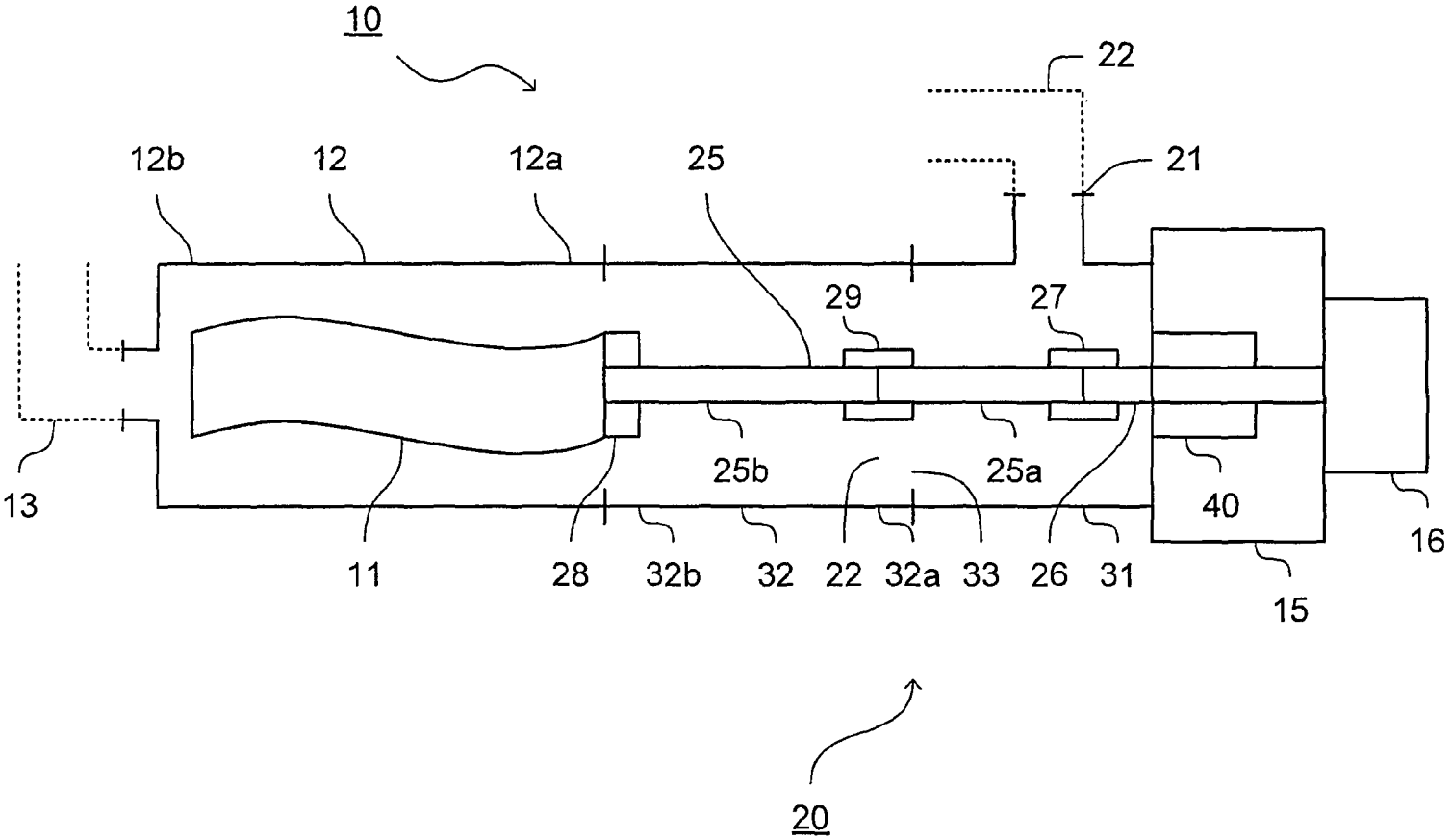

| | | | | |
|---|---|---|---|---|
| 2006/0083637 | A1* | 4/2006 | Marielle | 417/410.3 |
| 2009/0110579 | A1* | 4/2009 | Amburgey | 418/48 |

FOREIGN PATENT DOCUMENTS

| | | | |
|---|---|---|---|
| JP | S 45-14469 | A | 5/1970 |
| JP | 07-077172 | | 3/1995 |

* cited by examiner

PUMP WITH STATOR AND ROTOR SECTION ATTACHMENT FEATURES

CROSS-REFERENCES TO RELATED APPLICATIONS

This present application claims priority to PCT/GB2009/001857 filed Jul. 28, 2009 which claims priority to Great Britain Application no. 0813790.3, filed with the Great Britain Patent Office on Jul. 28, 2008 and entitled "PUMP", which is hereby incorporated by reference in its entirety.

The present application relates to pumps, in particular, progressive cavity pumps. Such pumps are typically formed from a rotor contained within a stator and that is driven to rotate in such a fashion that cavities between the rotor and the stator move along the stator, transporting fluid. A suction chamber may be provided at one end of the stator, having an inlet for receiving the fluid to be pumped and an outlet connected for fluid flow to the stator. A drive shaft is typically connected to the rotor in order to drive its rotation and, in many arrangements, the drive shaft passes through the suction chamber. At the opposite end of the stator to the suction chamber, the stator may be connected to pipe work that is arranged to convey the fluid being pumped to its required destination.

Progressive cavity pumps may be used in a variety of applications, such as food and drink pumping, sewage sludge pumping and slurry pumping. Progressive cavity pumps may be particularly useful where relatively low levels of shearing are desirable for the pumped fluid. However, progressive cavity pumps may require careful maintenance. In particular, wearing may occur between the surfaces of the rotor and the stator. Accordingly, the rotor and the stator may need to be replaced periodically. In addition, a seal may need to be provided at the point at which the drive shaft enters the suction chamber, in order to prevent fluid leakage. Accordingly, the seal may require further maintenance and/or periodic replacement.

Therefore, it is necessary to dismantle a progressive cavity pump periodically in order to perform maintenance operations. For presently known configurations of progressive cavity pumps, to do so it is necessary firstly to disconnect the pipe work connected to the stator end cover and provide sufficient space at that end of the stator for the stator to be withdrawn parallel to the axis of rotation of the rotor, exposing the rotor and enabling its disconnection from the drive shaft. Subsequently, the suction chamber may be detached from the pump, exposing the drive shaft and the seal, permitting their disassembly, removal and/or maintenance. However, in many applications, the rotor and the stator may be relatively long. Accordingly, removing the stator from the rotor longitudinally requires a considerable amount of space around the pump. Furthermore, dismantling the pipe work connected to the stator in order to permit its removal increases the time required to dismantle the pump.

Accordingly, it is an aim of the present invention to provide a progressive cavity pump that is quicker and easier to dismantle.

According to the present invention, there is provided a progressive cavity pump, comprising:

- a stator section and a rotor section axially aligned with and surrounded by the stator section, configured such that, when the rotor section rotates relative to the stator section, fluid within the stator section is driven along the axis of rotation of the rotor section;
- a drive shaft connection section, configured to be connected to a drive for driving the pump;

- a suction chamber, arranged between the stator section and the drive shaft connection section, having an inlet to receive fluid to be pumped and an outlet that is connected for fluid flow to the stator section;
- a connecting shaft, that connects the drive shaft connection section to the rotor section and passes through the suction chamber;
- wherein the drive shaft connection section comprises a drive shaft that passes through a seal that separates the suction chamber and the drive shaft connection section;
- the connecting shaft comprises a rotor-end portion and a drive-end portion, in which the rotor-end portion is connected to the rotor section, the drive-end portion is connected to said drive shaft and the rotor-end portion and the drive-end portion of the connecting shaft are connected by a releasable connection; and
- wherein the suction chamber is configured such that it can be disassembled, the rotor-end portion of the connecting shaft can be disconnected from the rotor section and the rotor-end portion of the connecting shaft can be disconnected from the drive-end portion without moving the stator section or the drive shaft connection section.

By specifically configuring the suction chamber such that it can be dismantled without moving the stator section or the drive shaft connection section, maintenance of the pump is facilitated. In particular, it may no longer be necessary to disconnect the process pipe work that is connected to the inlet and the outlet of the pump in order to perform maintenance. Accordingly, the time taken to perform a particular maintenance operation may be significantly reduced. Furthermore, it may be possible, for example, to remove and/or replace the rotor section and/or the stator section without dismantling any of the associated process pipe work, albeit that it will be appreciated that, if the stator is to be removed, it must be disconnected from the process pipe work, for example leaving the end cover in place.

By arranging the suction chamber such that, when it is dismantled, access is provided to the connecting shaft, it may be cleaned and inspected and, if required, disconnected from the rotor and/or the drive shaft connection section.

The drive shaft connection section includes a drive shaft that passes through a seal that separates the suction chamber from the drive shaft connection section and extends into the suction chamber. It will be appreciated that the seal will be configured to prevent flow of the fluid to be pumped between the suction chamber and the drive shaft connection section. The seal may be of any convenient type, for example a mechanical seal or a gland packing.

The connecting shaft has a rotor-end portion connected to the rotor and a drive-end portion connected to the drive shaft. In such an arrangement, the suction chamber may be arranged such that when it is disassembled, access is provided to the connecting shaft such that the connecting shaft may be disconnected from the rotor section without moving the stator section. Therefore, it may be possible to dismantle the connecting shaft, facilitating maintenance of the pump, without moving the stator section or the drive shaft connection section.

The rotor-end portion of the connecting shaft and the drive-end portion of the connecting shaft are separate components that are connected by a releasable connection. In particular, a split sleeve may be used to connect the two parts of the connecting shaft. However, it will be appreciated that other releasable connections may be used. Furthermore, the suction chamber is arranged such that, when it is disassembled, the rotor-end portion of the connecting shaft can be disconnected from the drive-end portion of the connecting shaft without moving the stator section or the drive shaft connection section.

In such an arrangement, it will be appreciated that, once the suction chamber is disassembled, access may be provided to the seal between the suction chamber and the drive shaft connection section. If required, the seal may be replaced without moving the stator section or the drive shaft connection section. Accordingly, the time taken to perform maintenance operations may be significantly reduced and the requirements for pipe work arranged around the pump may be simplified because the pump may be maintained without requiring the removal of the pipe work.

As noted above, the suction chamber may have inlet to receive the fluids to be pumped. In addition, an outlet of the pump may be arranged at the opposite end of the stator section to the end that is connected to the suction chamber. The outlet of the stator may be configured to be connected to at least one pipe to convey the fluid to the pump. It should be appreciated, however, that references to the inlet and the outlet of the pump may be reversed. In particular, the operation of the pump may be reversed such that the fluid being pumped enters the pump at the end of the stator referred to in this application as the outlet and exits the pump from the suction chamber at the point referred to in this application as the inlet.

As discussed above, the pump may particularly be configured such that, when the suction chamber is disassembled, the rotor section and/or the stator section can be removed from the pump without moving any of the associated process pipe work connected to the pump outlet, namely connected to the end of the stator section that is opposite to the end connected to the suction chamber. In a particular arrangement, the pump may be arranged such that the rotor section and/or the stator section may be detached from the pump with minimal movement of either the rotor section or the stator section in a direction parallel to the axis of rotation of the rotor section.

Accordingly, the rotor section and stator section may be removed, once the suction chamber is disassembled, by disconnecting the stator section from the associated process pipe work. In particular, the space made available by further disassembling the connecting shaft may allow the stator to move axially by a distance sufficient to disengage it from the end cover that joins it to the process pipe work. It will be appreciated that this distance may not be substantial, namely may be significantly smaller than the length of the stator. The stator section and rotor section may then be removed from the pump in a direction perpendicular to the axis of rotation of the rotor. Such an arrangement, in which the process pipe work does not have to be disturbed or moved, may significantly reduce the requirements for space around the pump that are necessary to perform maintenance operations.

The suction chamber may, for example, include an inlet portion that may be connected to the pipe work from which the pump receives the fluid to be pumped, and conduit portion. The conduit portion may include a first end and a second end and may be configured such that the fluid to be pumped can flow between the first end and the second end. The first end of the conduit portion may be connected to the inlet portion of the suction chamber and the second end of the conduit portion may be connected to the stator section. Both said connections may be releasable in order to permit the disassembly of the suction chamber. In particular, the suction chamber may be arranged such that the conduit portion can be disassembled without moving the inlet portion of the suction chamber. Accordingly, the disassembly of the conduit portion may permit access to the space within the conduit portion.

In one arrangement, the conduit portion may be divided by at least one releasable join line running from the first end of the conduit portion to the second end of the conduit portion. Accordingly, by disconnecting the at least one releasable join line and the two ends of the conduit portion, the conduit portion may be removed from the pump. For example, the conduit portion may be divided by two releasable join lines that each run from the first end to the second end of the conduit portion and, accordingly, divide the conduit portion into two separate sections. By disconnecting the two releasable join lines, the two separate sections of the conduit portion may be disconnected, facilitating their removal from the pump.

In particular, it should be appreciated that a connecting shaft such as that discussed above may pass through the conduit portion from the first end to the second end. Accordingly, the provision of at least one releasable join line that extends from the first end to the second of the conduit portion of the suction chamber permits the removal of the conduit portion from the pump without disconnecting the connecting shaft. Accordingly, once the conduit portion of the suction chamber has been removed, access to the connecting shaft is provided, enabling the performance of maintenance operations and/or the disconnection of the connecting shaft as discussed above without moving the stator section or the drive shaft connection section.

It will be appreciated that a seal may be provided along the releasable join lines in order to prevent any leakage of the fluid being pumped. For example, a gasket may be provided for each of the one or more releasable join lines.

Respective end portions may be provided that connect to the first and second end of the conduit portion. In particular, the end portions may be arranged such that they are clamped to the conduit portion when the conduit portion is formed by the joining of the at least one releasable join line. The end portions may include an opening permitting fluid flow through the conduit portion and, for example, at least one flange that may be connected to another component within the pump. For example, the first end portion may be configured such that it can be connected to the inlet portion of the suction chamber and the section end portion may be configured such that it can be connected to the stator section.

In an alternative arrangement, the conduit portion may be arranged such that, during disassembly, it can be slid in a direction parallel to its length, namely parallel to a direction extending from the first end of the conduit portion to the second end of the conduit portion, without removing the suction chamber from the pump. In sliding the conduit portion in this manner, the space that is contained by the conduit portion when the suction chamber is assembled may be exposed permitting, for example, access to the connecting shaft within and, for example, permitting its disconnection from the rotor section and/or the drive shaft connection section. In a particular configuration, the conduit portion may be arranged such that, during disassembly, it slides over a portion of the stator section to provide access to the space within the suction chamber.

Figure 2A:
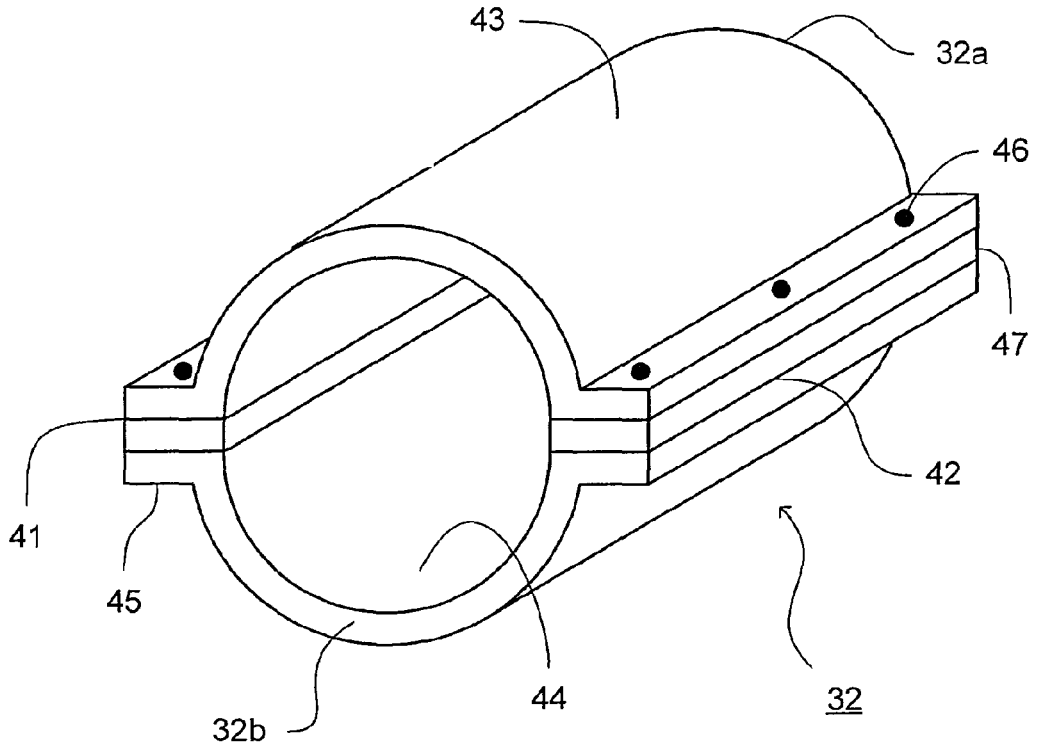
Figure 2B:
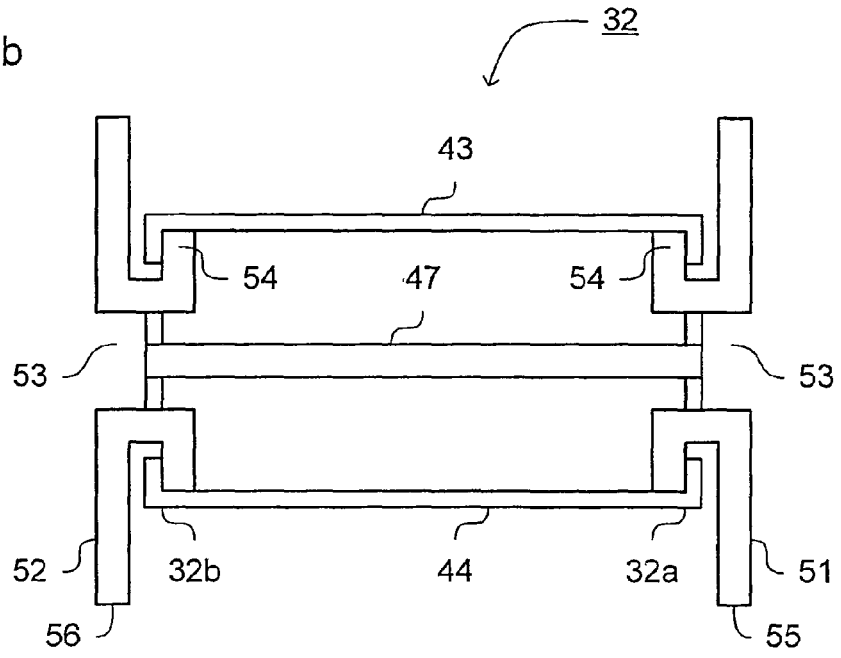
Figure 3A:
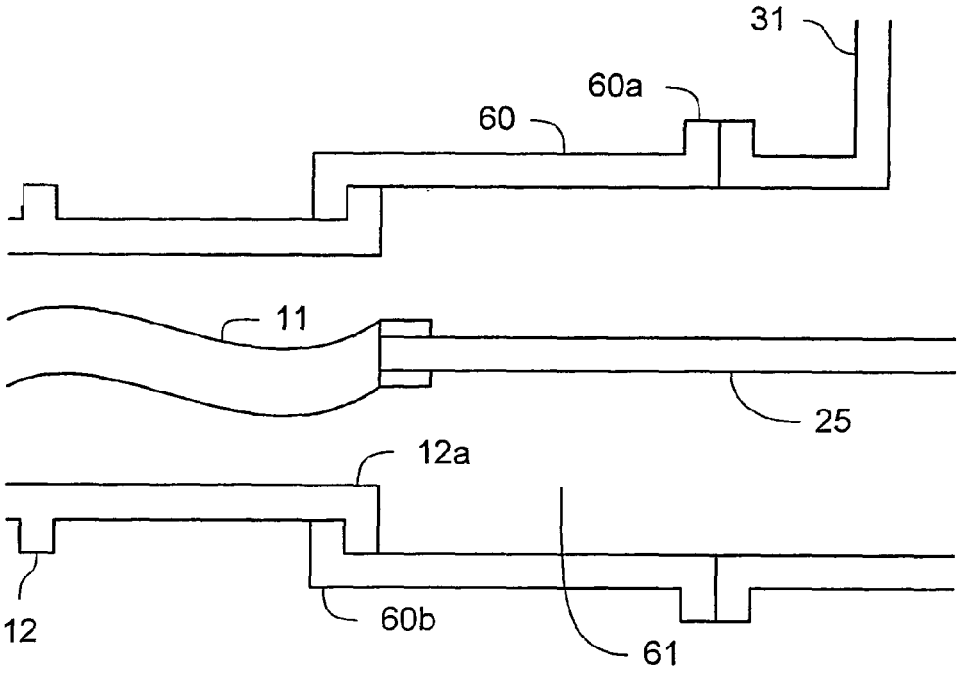
Figure 3B:
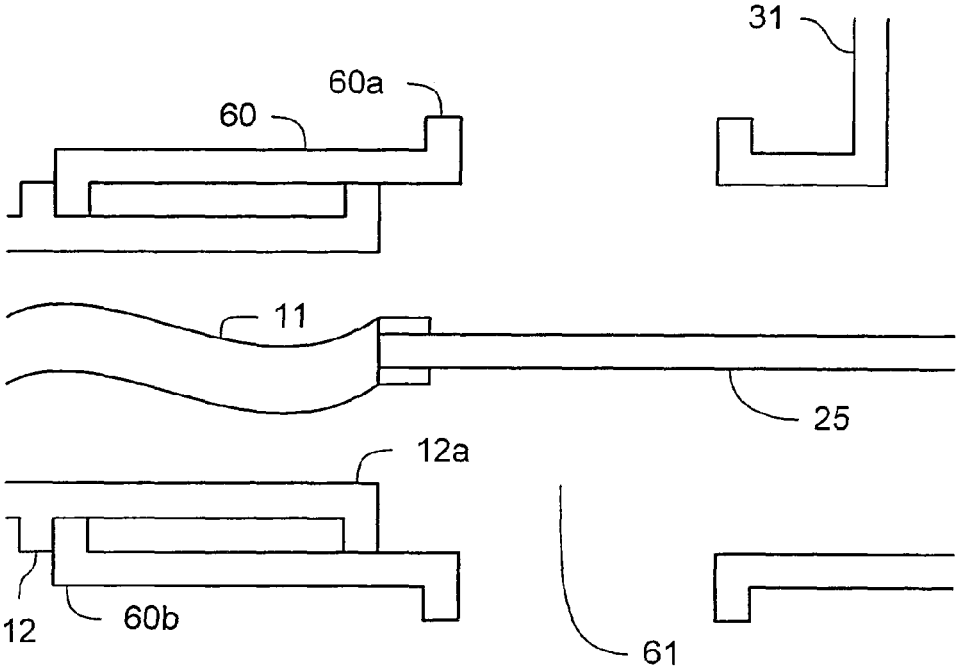

The present invention will now be described by way of non-limiting examples, with reference to the accompanying drawings in which:

FIG. 1 schematically depicts a first arrangement of a progressive cavity pump according to the present invention;

FIG. 2*a* depicts a conduit portion of a suction chamber that may be used in a pump according to the present invention;

FIG. 2*b* depicts a cross-section of a conduit portion such as that depicted in FIG. 2*a*; and FIGS. 3*a* and 3*b* depict an alternative arrangement of a conduit portion of a suction chamber that may be used in a pump according to the present invention, in an assembled and a disassembled state, respectively.

FIG. 1 depicts a progressive cavity pump 10 according to the present invention. In particular, the pump includes a rotor section 11 within a stator section 12. The rotor 11 may be driven to rotate relative to the stator 12 in order to drive fluid to be pumped from one end 12*a* of the stator to a second end 12*b* of the stator. Of course, it will be realised that, if required, the rotation of the rotor 11 may be reversed, driving the fluid in the opposite direction.

The second end 12*b* of the stator 12 may be connected to associated process pipe work 13 that conveys the pumped fluid away from the pump 10 via an end cover.

The pump further includes a drive shaft connection section 15 that may be connected to a drive 16. In particular, the drive shaft connection section 15 may provide a connection to the rotor 11 in order to drive the rotor to rotate relative to the stator.

The pump 10 further includes a suction chamber 20 that links the first end 12*a* of the stator 12, at which fluid is drawn into the stator 12 with an inlet 21 of the pump. The inlet 21 may be connected, for example, to further process pipe work 22 that provides the fluid to be pumped to the pump 10.

The suction chamber 20 encloses a space 22 through which the fluid to be pumped passes during operation of the pump 10. A connecting shaft 25 also passes through this space 22. The connecting shaft 25 provides a connection between the rotor 11 and the drive shaft connection section 15.

The drive shaft connection section 15 may include a drive shaft 26 that extends into the suction chamber 20 and is connected to the connecting shaft 25 by means of a releasable connection 27. Likewise, the connecting shaft 25 is connected to the rotor 11 by means of a further releasable connection 28. Accordingly, when the pump 10 is dismantled, the connecting shaft 25 may be disconnected from the rotor 11 and from the drive shaft 26.

As depicted, in the arrangement shown in FIG. 1, the connecting shaft 25 may include a drive-end portion 25*a* and rotor-end portion 25*b*, connected to the drive shaft 26 and the rotor 11, respectively. A further releasable connection 29 may be provided to connect the drive-end portion 25*a* and the rotor-end portion 25*b*. Accordingly, when the pump 10 is dismantled, the rotor-end portion 25*b* and the drive-end portion 25*a* of the connecting shaft 25 may be removed separately.

Any suitable connections 27,28,29 may be used to assemble the connecting shaft. In particular, for example, a split sleeve may be used as at least one of the releasable connections. Alternatively, or additionally, a pin joint may be used. In a particular arrangement, a pin joint may be used for the releasable connections, 27,28 connecting the connection shaft 25 between the drive shaft 26 and the rotor 11 and a split sleeve connection may be used for the connection 29 between the drive-end portion 25*a* and the rotor-end 25*b* of the connecting shaft 25.

As shown in FIG. 1, the suction chamber 20 may include an inlet portion 31 and a conduit portion 32. The inlet portion 31 may include the pump inlet 21 and an opening 33 for fluid transfer to the conduit portion 32.

The conduit portion may include a first end 32*a* connected to the inlet portion 31 and a second end 32*b* connected to the stator 12. Both ends 32*a*,32*b* of the conduit portion 32 are open, permitting fluid flow from the space contained by the inlet portion 31 of the suction chamber 20 to the inlet of the stator 12.

The pump 10 is specifically configured that the suction chamber 20 may be dismantled without requiring the movement of the stator 12, the rotor 11 or the drive shaft connection section 15, as was required in previously known pumps. Specifically, therefore, the suction chamber 20 may be dismantled without moving the stator, rotor or drive shaft connection section in order to provide access to the connecting shaft 25. Subsequently, this may permit the removal of the connecting shaft 25, again without moving the stator, rotor or drive shaft connection section. Thereafter, if required, the rotor 11 and/or the stator 12 may be easily removed, for example, for the performance of a maintenance operation. In particular, the rotor 11 and stator 12 may be removed in a direction perpendicular to the axis of rotation of the rotor 11. Consequently, it is not necessary to remove any of the process pipe work 13 that is connected to the outlet of the stator 12 in order to perform this operation.

Furthermore, once the suction chamber 20 has been dismantled, maintenance operations may be performed on the drive shaft connection section and/or it may be replaced if necessary. In particular, the drive shaft connection section 15 may include a seal 40 that is provided to prevent fluid leakage between the suction chamber 20 and the drive shaft connection section. The seal 40 may, for example, be a mechanical seal, a pack gland or any other convenient form of seal. It will be appreciated that the seal may require periodic maintenance operations. However, by disassembling the suction chamber 20 access may be provided to the seal 40, enabling the performance of the maintenance operation without requiring the removal of the rotor 11 or the stator 12.

It will be appreciated that the suction chamber may be configured in a plurality of different ways whilst still permitting disassembly from the pump 10 without requiring the movement of the stator 12 or the drive shaft connection section 15. FIGS. 2*a* and 2*b* depict a conduit portion 20 that may be used as part of a suction chamber 20 in the present invention. As shown in FIG. 2*a*, the conduit portion 32 includes first and second open ends 32*a* and 32*b*, permitting fluid flow through the conduit portion 32 and permitting the connecting shaft 25 to pass through the conduit portion 32.

The conduit portion 32 further includes two join lines 41,42 that extend from the first end 32*a* to the second end 32*b* of the conduit portion. Accordingly, the join lines divide the conduit portion 32 into a first section 43 and a second section 44. The join lines 41,42 are releasable, in order to permit the disassembly of the conduit portion 32 during the disassembly of the suction chamber 20. For example, as shown in FIG. 2*a*, each of the sections 43,44 of the conduit portion 32 may include flanges 45 that may be connected to the flanges 45 of the other section. The flanges 45 of the sections 43,44 of the conduit portion 32 may be connected by releasable fixings, for example, such as bolts 46.

In order to prevent fluid leakage from the conduit portion 32, a seal 47 may be provided for each of the releasable join lines 41,42. For example, a gasket may be provided for each of the releasable join lines 41,42.

It will be appreciated that, by dividing the conduit portion 32 into two sections 43,44 along the length of the conduit portion 32, the conduit portion 32 may be disassembled and removed from the pump without requiring the disconnection of the connecting shaft 25 passing through the conduit portion 32. Accordingly, the disassembly of the conduit portion may be used to provide access to the connecting shaft 25 in order to permit the disassembly of the connecting shaft 25 and, subsequently, any required disassembly of the remainder of the pump 10.

It should further be appreciated, that although the conduit portion 32 depicted in FIG. 2*a* has two releasable join lines 41,42 extending the length of the conduit portion 32, the present invention is not limited to such an arrangement. In particular, a greater number of releasable join lines may be provided, permitting the disassembly of the conduit portion 32 into a greater number of sections 43,44.

Furthermore, the conduit portion 32 may include only a single releasable join line that extends the full length of the conduit 32. However, in that case, the conduit portion 32 must be formed of a material that is sufficiently elastic that, when the releasable join line is released, the conduit portion 32 can deform sufficiently that the two edges of the releasable join line may be separated such that the conduit portion 32 can be removed from the pump. In particular, it will be appreciated that the separation between the edges of the releasable join lines must, in that case, be sufficient that the connecting shaft 22 can pass between them. It will also be appreciated that, where a plurality of releasable join lines are provided, the sections 43,44 of the conduit portion 32 need not be of the same size.

FIG. 2*b* depicts further detail of a conduit portion 32 such as that shown in FIG. 2*a*. In particular, FIG. 2*b* depicts a cross section of the conduit portion 32 depicted in FIG. 2*a*. As shown, at either end 32*a*,32*b* of the conduit portion 32, respective end portions 51,52 are provided.

Each of the end portions 51,52 includes an opening 53 that permits fluid flow through the conduit portion 32 and permits the arrangement of the connecting shaft 25 through the conduit portion 32. In addition, the end portions 51,52 each include engagement sections 54 that engage with the ends 32*a*,32*b* of the conduit portion 32. In particular, when the conduit portion 32 is assembled, namely when the releasable join lines are connected, the engagement portions 54 of the end portions 51,52 are clamped to the ends 32*a*,32*b* of the sections 43,44 of the conduit portion 32. Accordingly, when the conduit portion 32 is assembled, the end portions 51,52 are fixedly connected to the conduit portion 32.

The end portions 51,52 further include respective flanges 55,56 that are configured to connect the conduit portion 32 to other components within the pump. Accordingly, for example, the first end portion 51 may include one or more flanges 55 configured to connect the conduit portion 32 to the inlet portion 31 of the suction chamber 20. Likewise, the second end portion 52 may include one or more flanges 56 for connecting the conduit portion 32 to the stator 12.

Therefore, it will be realised that the conduit portion 32 of the kind depicted in FIGS. 2*a* and 2*b* and the end portions 51,52 may be disassembled from the pump without requiring movement of the stator 12, the rotor 11, the connecting shaft 25 or the drive shaft connection section 15. It will further be appreciated that variations of this arrangement may also be utilised without departing from the scope of the present invention as defined by the claims.

FIGS. 3*a* and 3*b* depict an alternative arrangement of a conduit portion 60 that may be used within a pump according to the present invention, in which the suction chamber may be disassembled without requiring the movement of the stator section 12 or the drive shaft connection section. FIG. 3*a* depicts the conduit portion 60 when the suction chamber is assembled and FIG. 3*b* depicts the arrangement of the conduit portion 60 when the suction chamber is partially disassembled.

As shown, a first end 60*a*, of the conduit portion of the arrangement depicted in FIGS. 3*a* and 3*b* may be connected to the inlet portion 31 of the suction chamber and a second end 60*b* of the conduit portion 60 may be connected to the first end 12*a* of the stator section 12. As with the previously described conduit portion, the conduit portion 60 of the arrangement depicted in FIGS. 3*a* and 3*b* is open at the first end 60*a* and the second end 60*b* and surrounds a space 61 through which the fluid to be pumped may flow and in which the connecting shaft 25 may be provided.

As depicted in FIG. 3*b*, in order to disassemble the suction chamber of a pump according the arrangement depicted in FIGS. 3*a* and 3*b*, the first and second ends 60*a*,60*b* of the conduit portion 60 may be disconnected from the inlet portion 31 of the suction chamber and the stator section 12, respectively. Subsequently, the conduit portion 60 may be slid in a direction parallel to its length, namely extending in the direction from the opening at the first end 60*a* to the opening at the second end 60*b*. In so doing, the space 61 that is surrounded by the conduit portion 60 when the suction chamber is fully assembled is exposed. Accordingly, access is provided to the space 61 permitting, for example, the disconnection of the connection shaft 25 from the rotor 11 and the subsequent disassembly of the connecting shaft 25 and the remainder of the suction chamber, as required.

As shown in FIGS. 3*a* and 3*b*, in a particular arrangement, the conduit portion 60 may be aligned with the stator section 12 and the rotor section 11 such that, when it is slid in its lengthways direction to disassemble the suction chamber, the conduit portion 60 slides back over at least a portion of the stator section 12, namely such that in the disassembled position (shown in FIG. 3*b*) it surrounds a portion of the stator section 12. Accordingly, the space 61 exposed by the movement of the conduit portion 60 is maximised, facilitating the access to disassemble the suction chamber and, subsequently, any other components of the pump 10.

It will be appreciated that seals, such a gaskets, may be provided between the conduit portion 60 and the inlet portion 31 and the stator section 12, respectively, when the suction chamber is fully assembled, in order to prevent fluid leakage.

The invention claimed is:

1. A progressive cavity pump, comprising:

a stator and a rotor axially aligned with and surrounded by the stator, configured such that, when the rotor rotates relative to the stator, fluid within the stator is driven along the axis of rotation of the rotor;

a drive shaft connection section connected to a drive for driving the pump and including a drive shaft;

a suction chamber, arranged between the stator and the drive shaft connection section, having an inlet to receive fluid to be pumped and an outlet that is connected for fluid flow to the stator;

a connecting shaft, that connects the drive shaft to the rotor and passes through the suction chamber;

wherein the connecting shaft includes separate components comprising a rotor-end portion and a drive-end portion, in which the rotor-end portion is connected to the rotor, and the drive-end portion is connected to said drive shaft;

further comprising:

a connecting shaft releasable connection that connects the rotor-end portion and the drive-end portion of the connecting shaft together such that the suction chamber is configured to be disassembled, whereby access to the connecting shaft is obtained;

wherein the suction chamber comprises a conduit portion that includes said outlet and at least one releasable join line that extends from the outlet to divide the conduit portion into a first section and a second section, such that the rotor-end portion of the connecting shaft is configured for disconnection from the drive-end portion upon disassembly of the suction chamber without moving the stator or the drive shaft connection section;

wherein the first section and the second section each have a respective first end and a respective second end;

wherein the conduit portion further includes a first engagement section and a second engagement section where each are configured to include an opening that permits fluid flow through the conduit portion and permit the connecting shaft to fit through; and the first end of both the first and second sections are clamped to the first engagement section, and the second end of both the first and second sections are clamped to the second engagement section.

2. The progressive cavity pump according to claim 1, further comprising a pump outlet, arranged at the opposite end of the stator to the end connected to the suction chamber and configured to be connected to at least one pipe to convey the fluid to be pumped;

wherein the progressive cavity pump is configured such that, when the suction chamber is disassembled, at least one of the rotor and the stator can be removed from the progressive cavity pump without moving said at least one pipe connected to the pump outlet.

3. The progressive cavity pump according to claim 1, wherein the suction chamber comprises an inlet portion as well as the conduit portion;

wherein the conduit portion is configured such that the fluid to be pumped can flow through the conduit portion from the first end to the second end of the conduit portion; and the suction chamber is configured such that the conduit portion can be disassembled without moving the inlet portion.

4. The progressive cavity pump according to claim 3, wherein the conduit portion is divided by the at least one releasable join line that runs from said first end of the conduit portion to said second end.

5. The progressive cavity pump according to claim 4, wherein the conduit portion is divided into the first section and the second section that are joined together by two of said at least one releasable join lines that run from said first end of the conduit portion to said second end.

6. The progressive cavity pump according to claim 5, further comprising at least one gasket configured to seal an associated releasable join line.

7. The progressive cavity pump according to claim 6, wherein the first and second engagement sections include at least one flange for connecting the conduit portion to another component within the progressive cavity pump.

8. The progressive cavity pump according to claim 1, wherein the first engagement section has a first groove and a second engagement section has a second groove that engage with the respective first and second ends of the first and second sections.

9. The progressive cavity pump according to claim 8, wherein the first section and the second section include undercut ends that engage with the respective first and second grooves of the first and second engagement sections.

10. A progressive cavity pump, comprising:

a stator and a rotor axially aligned with and surrounded by the stator, configured such that, when the rotor rotates relative to the stator, fluid within the stator is driven along the axis of rotation of the rotor;

a drive shaft connection section, configured to be connected to a drive for driving the pump and including a drive shaft;

a suction chamber, arranged between the stator and the drive shaft connection section, having an inlet to receive fluid to be pumped and an outlet that is connected for fluid flow to the stator;

a connecting shaft that connects the drive shaft to the rotor and passes through the suction chamber;

wherein the suction chamber includes a conduit portion having first and second open ends through which the connecting shaft passes and configured with a split construction comprising first and second sections that are releasably joined along join lines that extend from the first open end to the second open end such that the suction chamber may be disassembled by releasing the first and second sections from each other such that, upon disassembly of the suction chamber, access to the connecting shaft is obtained;

wherein the connecting shaft includes separate components comprising a rotor-end portion and a drive-end portion, the connecting shaft configured such that a connecting shaft releasable connection connects the rotor-end portion and the drive-end portion of the connecting shaft together;

wherein the conduit portion further includes a first engagement section and a second engagement section where each are configured to include an opening that permits fluid flow through the conduit portion and permit the connecting shaft to fit through; and the first open end of both the first and second sections are clamped to the first engagement section, and the second open end of both the first and second sections are clamped to the second engagement section.

11. The progressive cavity pump according to claim 10, wherein the progressive cavity pump is configured such that the first and second sections of the conduit portion can be released from each other along the join lines, and the rotor-end portion and the drive-end portion of the connecting shaft may be released from each other at the connecting shaft releasable connection and separately removed from the progressive cavity pump.

12. The progressive cavity pump according to claim 10, wherein the pump is configured such that the first and second sections of the conduit portion can be released from each other along the join lines, and the rotor and stator may be detached and removed from the pump without requiring substantial movement of either the rotor or stator in a direction parallel to said axis of rotation.

13. The progressive cavity pump according to claim 10, wherein the first engagement section has a first groove and a second engagement section has a second groove that engage with the respective first and second open ends of the first and second sections.

14. The progressive cavity pump according to claim 13, wherein the first section and the second section include undercut ends that engage with the respective first and second grooves of the first and second engagement sections.

15. A progressive cavity pump, comprising:

a stator and a rotor axially aligned with and surrounded by the stator, configured such that, when the rotor rotates relative to the stator, fluid within the stator is driven along the axis of rotation of the rotor, wherein the stator and rotor are elongate in a direction parallel to the axis of rotation of the rotor relative to the stator;

a drive shaft connection section, configured to be connected to a drive for driving the pump and including a drive shaft;

a suction chamber, arranged between the stator and the drive shaft connection section, having an inlet to receive fluid to be pumped and an outlet that is connected for fluid flow to the stator;

a connecting shaft, that connects the drive shaft to the rotor and passes through the suction chamber;

wherein the connecting shaft includes separate components comprising a rotor-end portion and a drive-end portion that can be disassembled, in which the rotor-end portion is connected to the rotor, and the drive-end portion is connected to said drive shaft;

wherein the progressive cavity pump further comprises:

a first releasable connection that connects the drive shaft to the connecting shaft;

a second releasable connection that connects the rotor-end portion and the drive-end portion of the connecting shaft together; and a third releasable connection that connects the connecting shaft to the rotor, such that the suction chamber is configured to be disassembled, and access to the connecting shaft is obtained when the suction chamber is disassembled, and wherein the suction chamber comprises a conduit portion that includes said outlet and at least one releasable join line that extends from the outlet to divide the conduit portion into a first section and a second section, such that the rotor-end portion of the connecting shaft is configured for disconnection from the drive-end portion upon disassembly of the suction chamber without moving the stator or the drive shaft connection section, and such that, when the suction chamber is disassembled, the rotor and stator may be detached and removed from the pump without requiring substantial movement of either the rotor or stator in a direction parallel to said axis of rotation;

wherein the first section and the second section each have a respective first end and a respective second end;

wherein the conduit portion further includes a first engagement section and a second engagement section where each are configured to include an opening that permits fluid flow through the conduit portion and permit the connecting shaft to fit through; and the first end of both the first and second sections are clamped to the first engagement section, and the second end of both the first and second sections are clamped to the second engagement section.

16. The progressive cavity pump according to claim 15, wherein the first engagement section has a first groove and a second engagement section has a second groove that engage with the respective first and second ends of the first and second sections.

17. The progressive cavity pump according to claim 16, wherein the first section and the second section include undercut ends that engage with the respective first and second grooves of the first and second engagement sections.

* * * * *